United States Patent [19]

Link

[11] Patent Number: 5,063,640

[45] Date of Patent: Nov. 12, 1991

[54] ENDLESS FILAMENT PAPER CLIP

[76] Inventor: Charles T. Link, 6227 Pattypeart Way, Carmichael, Calif. 95608

[21] Appl. No.: 604,055

[22] Filed: Oct. 26, 1990

[51] Int. Cl.[5] ..... B42F 1/02; A44B 21/00

[52] U.S. Cl. ..... 24/67.9; 24/67.3; 24/552

[58] Field of Search ..... 24/67.9, 67.3, 67 R, 24/546, 556, 550, 552

[56] References Cited

U.S. PATENT DOCUMENTS

| | | | |
|---|---|---|---|
| 1,053,008 | 2/1913 | Carbis . | |
| 1,251,884 | 1/1918 | Hann | 24/552 |
| 1,271,043 | 7/1918 | Lee | 24/552 |
| 1,767,973 | 6/1930 | Gedney | 24/552 |
| 2,061,474 | 11/1936 | Metzs | 24/552 |
| 2,074,613 | 3/1937 | Laursen | 24/552 |
| 2,152,075 | 3/1939 | Melehes | 24/552 |
| 2,239,584 | 4/1941 | Zane | 24/552 |
| 4,170,052 | 10/1979 | Okerblom . | |
| 4,480,356 | 11/1984 | Martin | 24/67.3 |

*Primary Examiner*—Victor N. Sakran

*Attorney, Agent, or Firm*—James M. Ritchey

[57] ABSTRACT

A paper clip for securing to at least one sheet of thin material comprises a continuous or endless filament shaped to provide two oppositely facing pincers. Each oppositely facing pincer has a resilient hinge region connecting and urging toether an opposing pair of pincer finger members with each pincer finger member comprising a tip segment, an inner gripping segment, and an outer edge segment. The sheet of thin material is secured between either of the oppositely facing pincers by the inner gripping segments of the respective pair of opposing pincer finger members.

20 Claims, 4 Drawing Sheets

ENDLESS FILAMENT PAPER CLIP

BACKGROUND OF THE INVENTION

1. Field of the Invention

This invention relates to an improved clip for securing one or more sheets of thin material. In particular, the subject apparatus comprises an endless filament configured as a two ended and generally symmetrical paper clip that has oppositely facing pincers. The clip may be fitted over a sheet of paper from either end of the clip with either face of the clip oriented toward the user and held in place by two torsion hinges that are continuous with each of the pincers.

2. Description of the Background Art

Historically, filament or wire type holding devices for securing a plurality of thin paper sheets or marking devices for identifying a particular sheet or sheets of paper have consisted of a piece of metal wire or plastic material formed into a desired shape for fitting over the edge or edges of the paper. The most traditional version of such a paper holder is a "flat coil clip" or "standard paper clip" that comprises a two ended strand of wire bent in an oblong coil to create a single pincer having a distal spring hinge region connecting a proximal small tip domain to a proximal large tip domain. One or more sheets of paper are held between the small and large tip domains by pressure exerted by and through the hinge region. Practically speaking, such a clip fits over the edge of a sheet of paper in only one orientation (i.e., between the pincer with the hinge region proximate the edge of the paper).

More specifically, U.S. Pat. No. 1,053,008 discloses a generally flattened paper clip consisting of a two ended piece of wire bent into a shape that produces, when fitted over a sheet of paper having two sides, two separate wire configurations on one side and one continuous wire configuration on the other side of the paper. The device is not symmetrical, but may be rotated 180° about an axis perpendicular to the generally flattened plane of the device for fitting over a sheet of paper in two distinctly different orientations.

U.S. Pat. No. 4,170,052 relates to a continuous or endless filament paper clip. This clip is much like the two ended "standard paper clip" described above except that the filament is continuous or without ends.

SUMMARY OF THE INVENTION

An object of the present invention is to produce an improved paper clip with substantially greater gripping strength, for a given gauge of wire, than a traditional paper clip.

An additional object of the present invention is to generate an improved paper clip comprising a continuous or endless wire that minimizes tearing or scratching the paper to which the clip is applied.

A further object of the subject invention is to provide an improved paper clip that when applied to paper lies essentially flat against both surfaces of the paper.

Yet a further object of the subject invention is to make an improved paper clip that by virtue of its continuous or endless construction resists interlocking with adjacent clips to form inconvenient chains.

Still an additional object of the subject invention is to create an improved essentially symmetrical paper clip having two operable ends that may be applied equally well from either end over the edge of paper with either face of the clip oriented toward the user.

An essentially symmetrical paper clip having three mutually orthogonal two-fold or 180° rotational axes is disclosed. The clip is for securing to or fastening to other sheets at least one sheet of thin material, usually a paper or plastic product. Comprising the clip is a continuous or endless filament configured, shaped, or bent to generate two oppositely facing pincers. Each of the pincers has a resilient hinge region connecting and urging together an opposing pair of pincer finger members with each pincer finger member comprising a tip segment, an inner gripping segment, and an outer edge segment. The sheet of thin material is secured between either of the oppositely facing pincers by the inner gripping segments of the respective pair of opposing pincer finger members. By virtue of a concave bend in each tip segment, when the clip is secured to the thin material each finger member lies flush with a surface of the thin material.

Other objects, advantages, and novel features of the present invention will become apparent from the detailed description that follows, when considered in conjunction with the associated drawings.

DESCRIPTION OF THE PREFERRED EMBODIMENT

Figure 1:
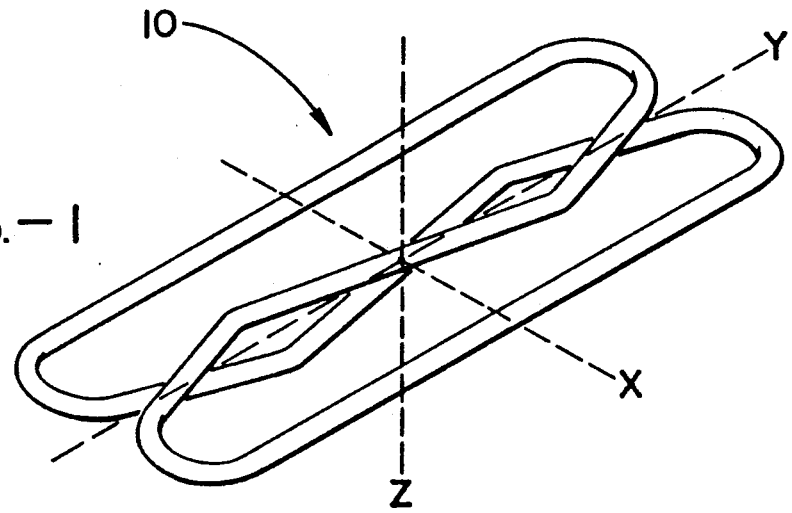
FIG. 1 is a perspective view of the subject apparatus showing three mutually orthogonal axes.
Figure 3:
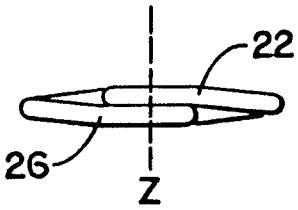
FIG. 3 is a top view of the subject apparatus.

Referring now to FIGS. 1–8, there is shown a preferred embodiment of a clip 10 for securing over the edge of a sheet of thin material. The clip 10 is used to mark a particular sheet or to secure together a plurality of such sheets. Although each sheet of thin material is usually a sheet of paper, other thin materials are equally suited such as plastic or metal products and similar items.

As shown in FIGS. 1, 2A, 3, 4, 5, and 6, to better explain the subject apparatus 10, three mutually orthogonal axes (X, Y, and Z) will be employed. The three axes have a commong origin midway between the opposing ends of the subject device 10 and the sides of the apparatus 10. Two of the three two-fold rotational axes (specifically X and Y) form a plane within which most of the subject device 10 lies. A significant degree of symmetry exists for the preferred embodiment of the subject invention 10. Around each of the three orthogonal axes there is a two-fold or 180° rotational symmetry for the subject apparatus 10. If the subject device 10 is rotated 180° about any of the three axes the original structure is reproduced. Although this is the preferred embodiment, structural distortions of the subject 10 invention's dimensions that generate an essentially equivalent device are considered to be within the realm of this disclosure, even if one or more of the 180° rotational symmetry elements is destroyed.

FIG. 1 clearly depicts the preferred embodiment of the subject apparatus 10. A continuous or endless filament is shaped or bent to form two oppositely facing pincers. The endless filament feature of the subject invention clip 10 eliminates exposed filament ends that might damage the secured sheets. Also, as seen in more detail below, the endless filament of the subject apparatus 10 avoids the traditional paper clip problem of interlocking clips that produce annoying chains that must be unlinked before use. The filament is usually fabricated from metal wire, but may be made from suitable polymers, combinations of metals and polymers, or similar substances. If constructed from a metal wire, the wire's ends are secured to each other by standard techniques such as soldering, welding, melting, and the like.

Since one of the objects of the subject invention 10 is to generate a generally symmetrical, flattened, and elongated two ended clip 10 that may be applied to a thin sheet or sheets equally well from either end, with either face (a face being the clip profile viewed from either side of the X-Y plane) of the clip oriented toward the user, when one end of the clip 10 is fitted over the sheet as pincers, the other end acts as a resilient or gripping hinge region that forces the pincers to be secured to the sheet. When the clip 10 is oriented in the opposite manner (rotated about the X or Z axes by 180°), the end that served as the gripping hinge region is now the pincers and the original pincers is now the gripping hinge region. Due to this rotational symmetry, certain elements of the apparatus 10 wear two "hats", depending upon which end of the clip 10 is applied to the sheet of thin material.

Figure 2A:
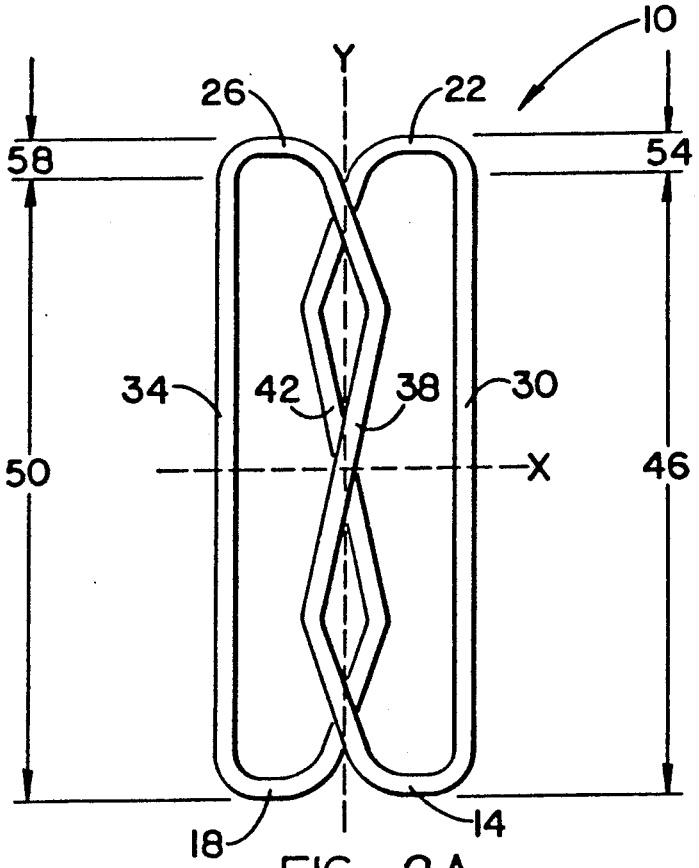
FIG. 2A is a front view of the subject apparatus particularly showing a first set of two oppositely facing pincers.
Figure 2B:
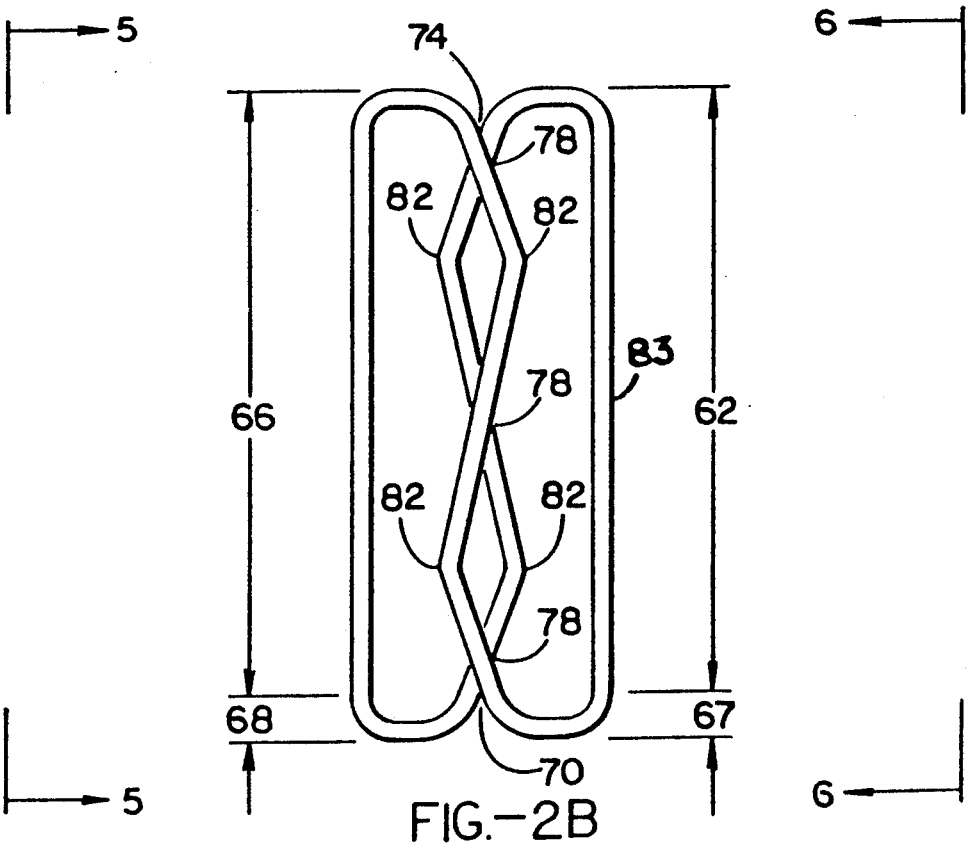
FIG. 2B is a front view of the subject apparatus particularly showing a second set of two oppositely facing pincers.

FIGS. 2A and 2B illustrate two orientations in which the clip 10 is employed for application to a sheet (in FIG. 2A a sheet enters a clip 10 through the lower pincers and in FIG. 2B a sheet enters the clip 10 through the upper pincers). The clip 10 comprises an endless filament shaped or bent as two oppositely facing pincers comprising first 14, second 18, third 22, and fourth 26 tip segments. Connecting the tip segments (14, 18, 22, and 26) are first 30 and second 34 outer edge segments and first 38 and second 42 inner gripping segments.

FIG. 2A depicts one of the subject device's two oppositely facing pincers having a first pincer finger member 46 (including the first tip segment 14, the first outer edge segment 30, and the first inner gripping segment 38) and a second pincer finger member 50 (including the second tip segment 18, the second outer edge segment 34, and the second inner gripping segment 42). These two paired pincer finger members (46 and 50) are connected (cantilevered) to one another and urged towards one another by a resilient hinge region comprising a first torsional hinge 54 (within the third tip segment 22) and a second torsional hinge 58 (within the fourth tip segment 26). In manufacturing the clip 10, the filament in the region of each tip may be slightly twisted (to force each pincers closed by forcing each of the paired pincer finger members towards one another) to preload the pincers with torsional stress to increase the strength of the various torsional hinges.

FIG. 2B shows the subject device's other pincers comprising a third pincer finger member 62 (including the third tip segment 22, the first outer edge segment 30, and the second inner gripping segment 42) and a fourth pincer finger member 66 (including the fourth tip segment 26, the second outer edge segment 34, and the first inner gripping element 38). In an analogous manner with the above pincers, these two paired pincer finger members (62 and 66) are connected to one another and urged towards one another by a resilient hinge region comprising a third torsional hinge 67 (within the first tip segment 14) and a fourth torsional hinge 68 (within the second tip segment 18). It should be noted that with the subject apparatus 10, both oppositely facing pincers are connected by two torsional hinges, not one as with most traditional paper clips, thereby increasing the gripping strength of the subject clip 10.

As can be seen in FIGS. 2A and 2B, each one of the oppositely facing pincers has an opening to accept a sheet of thin material. For the paired first 46 and second 50 pincer finger members, a first paper entrance 70 exists between the inner gripping segments proximate the first 14 and second 18 tip segments. Likewise, for the paired third 62 and fourth 66 pincer finger members, a second paper entrance 74 exists between the inner gripping segments proximate the third 22 and fourth 26 tip segments.

Both the first 38 and second 42 inner gripping segments have a plurality of contact gripping regions 78 generated by gripping elbow 82 bends in each gripping segment that introduce overlapping sections (gripping regions 78) in the two inner gripping segments. In the preferred embodiment of the subject clip 10, the number of overlapping areas gripping regions 78 is three, but other numbers of overlapping gripping regions 78 are within the province of this disclosure. The three spaced gripping regions 78 hold fully inserted, secured sheets near both ends of the clip 10 and at the center of the clip 10 to provide optimum resistance to slipping and rotation of the sheets relative to one another and to the clip 10. The angle between the inner gripping segments (38 and 42) at each paper entrance (70 and 74) is sufficiently narrow to facilitate engagement or securement of sheets within the clip 10, but wide enough to allow adequate overlapping of the gripping elbows 82 so that the inner gripping segments (38 and 42) will retain their overlapping relationship during use of the clip 10.

To produce three gripping regions 78, each inner gripping segment has two, oppositely bent, gripping elbow 82 bends. Clearly, taking FIG. 2A as a specific example, when a sheet of thin material is inserted through the first paper entrance 70, a holding force is generated by the twisting displacement within the filament segments comprising the two torsional hinges (54 and 58) that presses the first pincer finger member 46 towards the second pincer finger member 50. When the sheet is fully inserted within the pincers (the sheet stops against the inner sides of torsional hinges or end segments 22 and 26), the three contact gripping regions 78 press against the sheet and securely hold it in place. For the oppositely facing pincers, an analogous action occurs through the second paper entrance 74. By having two torsional hinges acting for each pincers a firm holding force is generated.

To further increase the holding force of the clip 10, a twist may be placed within the length of one or both of the two outer edge segments (30 and 34). Such a twist produces an additional torsional forces that presses the inner gripping segments together with more strength than just having the end segment torsional hinges. Further, since the clip 10 is an endless filament, if the clip 10 is fabricated from a piece of wire having two ends, when the two ends are secured together by welding (or the like) in an outer edge segment (for example at point 83 in FIG. 2B), an additional gripping force between the inner gripping segments (38 and 42) may be introduced by bending (before the welding) the wire ends in opposite directions from the X-Y plane (above and below the X-Y plane) before welding.

Figure 4:
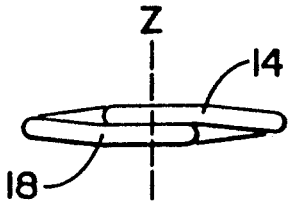
FIG. 4 is a bottom view of the subject apparatus.
Figure 5:
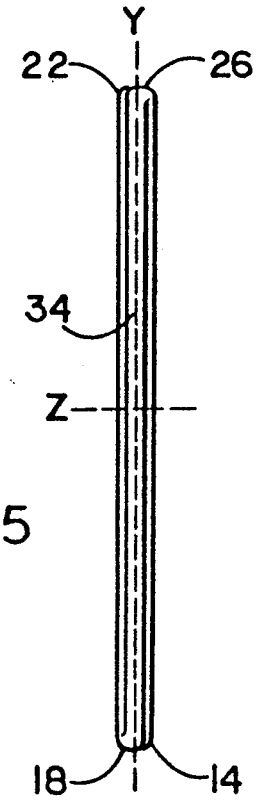
FIG. 5 is a side view of the subject apparatus as seen from line 5—5 in FIG. 2B.
Figure 6:
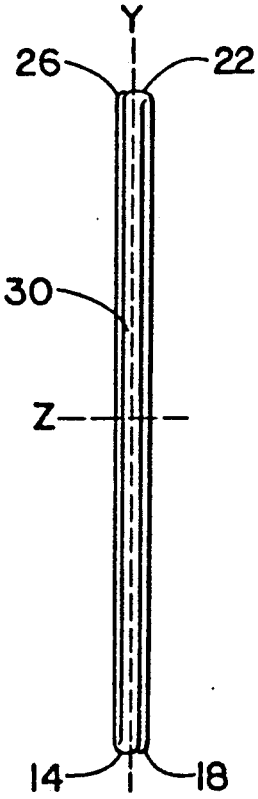
FIG. 6 is a side view of the subject apparatus as seen from line 6—6 in FIG. 2B.

Prior paper holding clips had the problem that when too many sheets were inserted within their holding mechanisms the holding mechanisms would distort and project away from the surface of the held sheets, thereby interfering with stacking or moving of other papers above or below the secured sheets. As shown particularly in FIGS. 3 and 4, this distortion problem is overcome in the subject device 10 by having each of the end or tip segments (14, 18, 22, and 26) bent concavely towards one another. Looking down the Y axis in FIG. 3, or into the drawing, tip segments 22 and 26 are seen to overlap on a portion of their length, but the non-overlapping length of each tip segment bends clockwise from the overlapping portion to generate the concave bend. The same relative clockwise bend relationship is seen in FIG. 4 for tip segments 14 and 18. When a sheet is inserted into a pincers, the concave bend in each torsional hinge for both pincers enables each outer edge segment (30 and 34) to contact the sheet essentially throughout each outer edge segment's length.

Figure 7:
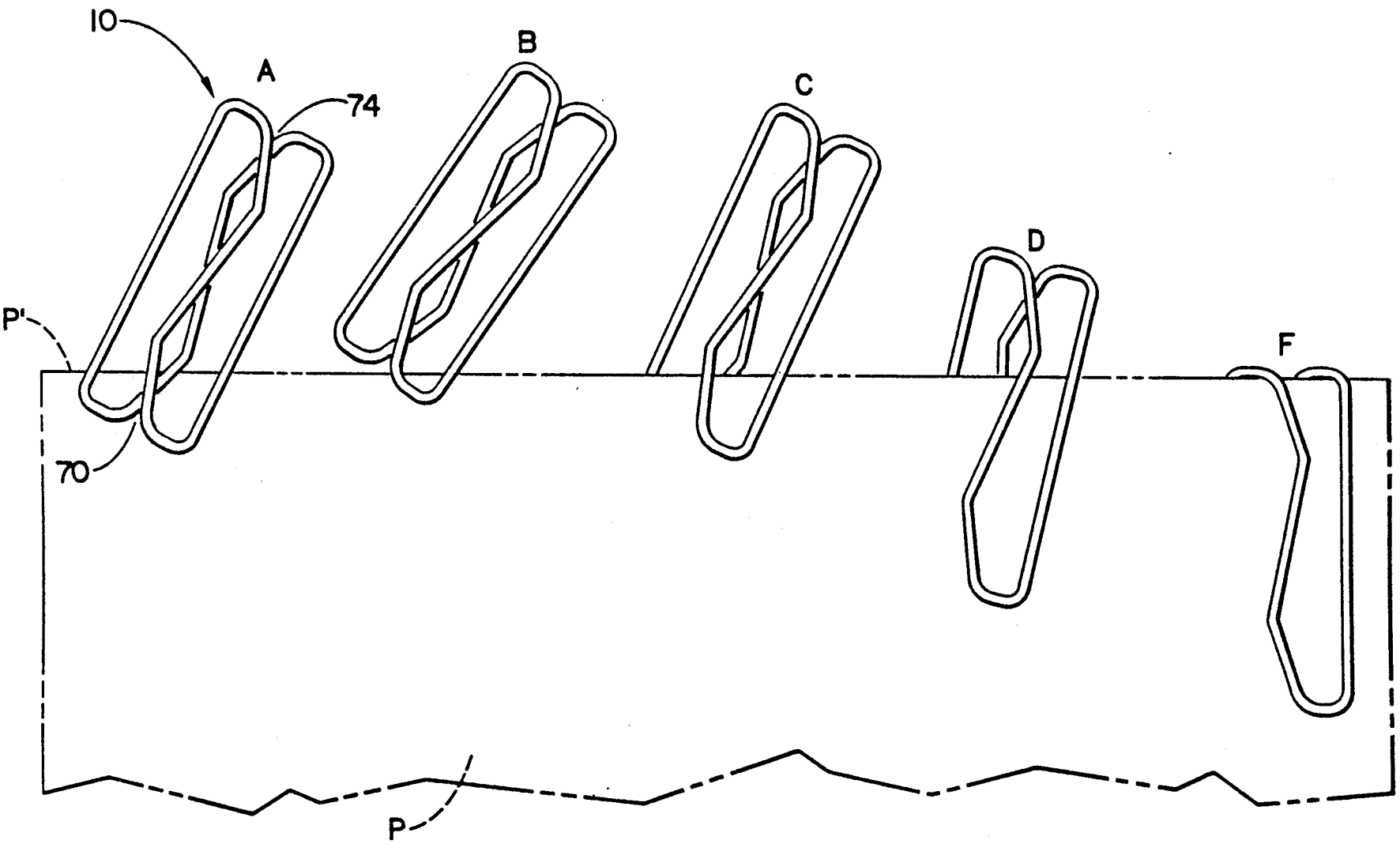
FIG. 7 is a time-lapse series of front views of the subject apparatus illustrating the spring-insertion method of fitting the subject apparatus over a sheet of paper.

The subject device 10 benefits from two methods for engagement with sheets of thin material. First, as seen in FIG. 7 in a time-lapse series of front views of the subject apparatus 10, a spring-insertion method is depicted for fitting the subject apparatus over an edge P' of a sheet of paper P. In step A, the clip 10 is positioned with one pair of tip segments (here tip segments 14 and 18, but since the oppositely facing pincers are adapted to engage and secure the thin material in like manner at opposite ends of the apparatus, independently of whether the apparatus is rotated 180° from an initial engaging position about any of the three mutually orthogonal axes located centrally within the apparatus, tip segments 22 and 26 are equally acceptable when engaging the opposite end of the clip with the paper sheet) slightly overlapping the paper edge P', with the clip 10 angled to the right, relative to the normal from the paper edge P'. In step B, the clip 10 is moved nearer the edge P' until the rear tip segment 18 slips off the edge P' and drops slightly behind the sheet P, thereby introducing the edge P' into the paper entrance 70. In steps C and D, the clip 10 is moved progressively into full engagement, at step F, with the sheet P.

Figure 8:
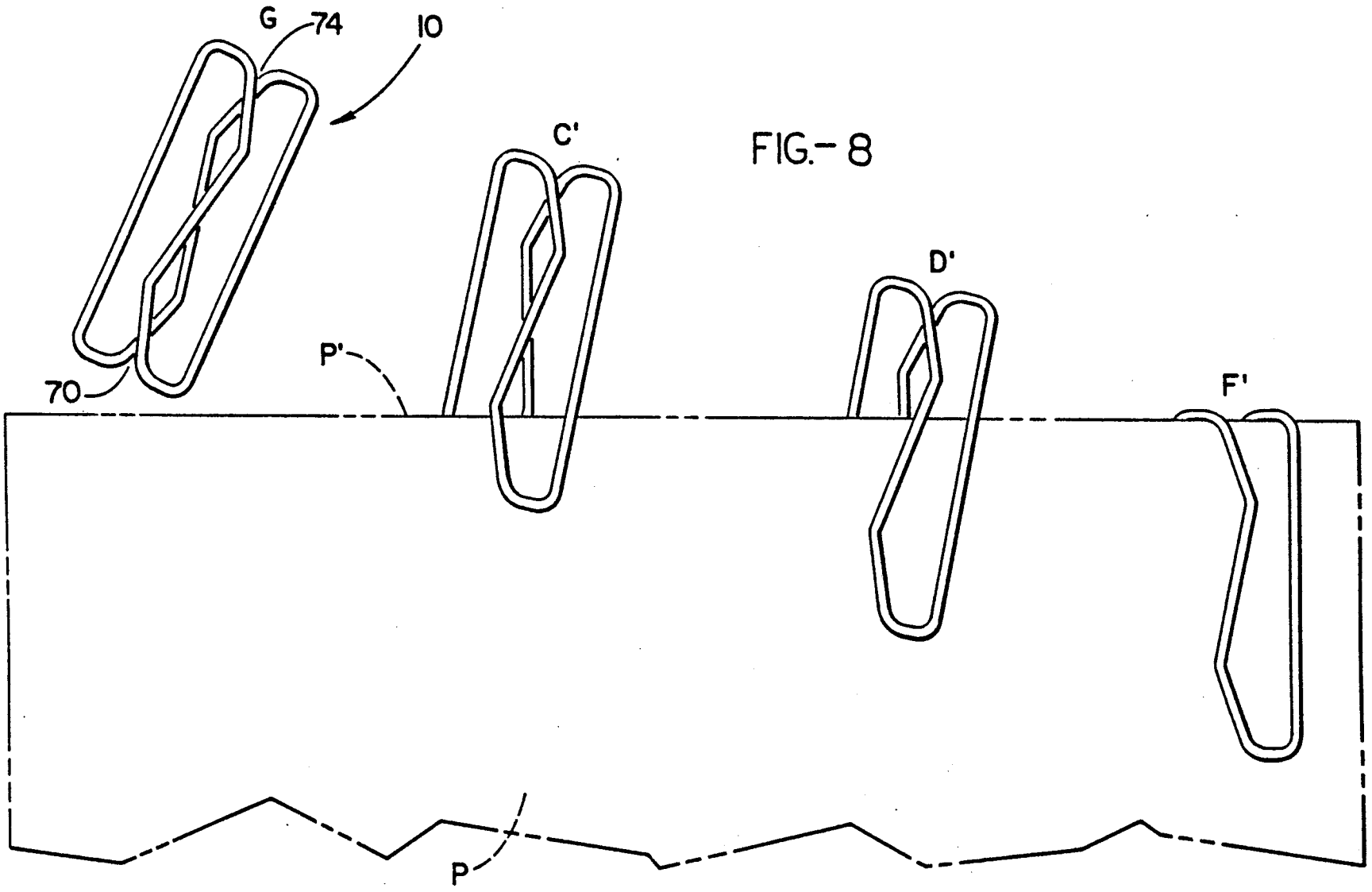
FIG. 8 is a time-lapse series of front views of the subject apparatus illustrating the plunge-insertion method of fitting the subject apparatus over a sheet of paper.

A second method of engagement of the subject invention 10 with a sheet is illustrated in FIG. 8. FIG. 8 is a time-lapse series of front views of the subject apparatus 10 showing a plunge-insertion method of fitting the subject apparatus over an edge P' of a sheet of paper P. In step G, a more direct method is depicted in which the angled clip 10 is above the paper edge P'. The user directly plunges the clip 10 over the edge P' and introduces the sheet into paper entrance 70 (or 74 for the opposite clip orientation), as seen in step C'. The clip 10 is then moved through intermediate positioning step D' and into full engagement at step F'.

As just indicated, since the subject clip 10 is preferably highly symmetrical, the clip 10 is able to be introduced over paper from either end paper entrance 70 or 74. Once again, this symmetry feature results from three mutually orthogonal two-fold rotational axes having a common origin midway between the first and the second tip segments and the first and the second torsional hinges. Two of the three two-fold rotational axes (X and Y) form a plane generally bisecting the tip segments, the outer edge segments, the torsional hinges, and the inner gripping segments. If the clip 10 were fitted to a thin sheet, this X-Y plane would generally include the thin sheet while the third axis (Z) would project above and below the sheet.

Two further inherent advantages of the subject apparatus 10 over a "standard paper clip" should be noted. Manufacturing the subject clip 10 requires essentially the same amount of filament as a "standard paper clip", yet the subject clip 10 yields a much higher gripping force. Additionally, even though the width of the subject clip 10 (between outer edge segments 30 and 34) is greater than a "standard paper clip", once the subject clip 10 is fully engaged over a sheet P (see FIGS. 7 and 8), the appearance or visible size on each surface of the paper P is approximately the same as with a "standard paper clip".

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A generally flattened and elongated clamping apparatus for securing to at least one sheet of thin material comprising an endless filament shaped to provide two oppositely facing pincers opening away from one another with each of said pincers comprising a resilient hinge region connecting and urging together an opposing pair of pincer finger members which provide a sheet entrance and a gripping region for said material with each pincer finger member comprising a tip segment, an inner gripping segment, and an outer edge segment wherein said sheet is secured within either of said oppositely facing pincers by said inner gripping segments of said pair of opposing pincer finger members.

2. An apparatus according to claim 1, wherein for each of said oppositely facing pincers each said resilient hinge region comprises two torsional hinges with one said torsional hinge at each tip segment of said opposing pincer.

3. An apparatus according to claim 1, wherein said inner gripping segments overlap each other at a plurality of contact gripping regions for securing said thin material.

4. An apparatus according to claim 3, wherein said plurality of contact gripping regions is three.

5. An apparatus according to claim 1, wherein said opposing pairs of pincer finger members of said oppositely facing pincers are adapted to engage and secure said thin material in like manner at opposite ends of said apparatus.

6. A generally symmetrical, flattened and elongated clamping apparatus for securing to at least one sheet of thin material comprising an endless filament shaped to provide two oppositely facing pincers opening away from one another with each of said pincers comprising a resilient hinge region connecting and urging together an opposing pair of pincer finger members which provide a sheet entrance and a gripping region for said material with each pincer finger member comprising a tip segment, an inner gripping segment, and an outer edge segment wherein said sheet is secured within either of said oppositely facing pincers by said inner gripping segments of said pair of opposing pincer finger members.

7. An apparatus according to claim 6, wherein for each of said oppositely facing pincers each said resilient hinge region comprises two torsional hinges with one said torsional hinge at each tip segment of said opposing pincer.

8. An apparatus according to claim 6, wherein said inner gripping segments overlap each other at three contact gripping regions for securing said thin material.

9. An apparatus according to claim 6, wherein said opposing pairs of pincer finger members of said oppositely facing pincers are adapted to engage and secure said thin material in like manner at opposite ends of said apparatus independently of whether said apparatus is rotated 180° from an initial engaging position about any of three mutually orthogonal axes located centrally of said apparatus.

10. A generally symmetrical, flattened, and elongated clamping apparatus for securing to at least one sheet of thin material comprising an endless filament shaped to provide two oppositely facing pincers, wherein each of said oppositely facing pincers comprises:

a) a first pincer finger member comprising:
- a first tip segment having first and second ends;
- a first outer edge segment having first and second ends extending by said first outer edge segment first end from said first tip segment first end along a first outer edge of said apparatus;
- a first inner gripping segment having first and second ends extending by said first inner gripping segment first end from said first tip segment second end along a sheet gripping region;

b) a second pincer finger member comprising:
- a second tip segment having first and second ends;
- a second outer edge segment having first and second ends extending by said second outer edge segment first end from said second tip segment first end along a second outer edge of said apparatus;
- a second inner gripping segment having first and second ends extending by said second inner gripping segment first end from said second tip segment second end along said sheet gripping region; and c) a resilient hinge region comprising first and second torsional hinges with each said first and said second hinges having first and second ends wherein said first torsional hinge first end is continuous with said first outer edge segment second end, said first torsional hinge second end is continuous with said second inner gripping segment second end, said second torsional hinge first end is continuous with said second outer edge segment second end, and said second torsional hinge second end is continuous with said first inner gripping segment second end whereby said first and second torsional hinges urge said first and said second pincer finger members together along said sheet gripping region between said first and said second inner gripping segments thereby securing said thin material.

11. An apparatus according to claim 10, wherein said first and said second inner gripping segments overlap each other in said sheet gripping region at plurality contact gripping regions for securing said thin material.

12. An apparatus according to claim 10, wherein said first and said second tip segments each bend concavely towards one another thereby enabling each said outer edge segment to contact said thin material essentially throughout said outer edge segment's length.

13. An apparatus according to claim 10, further comprising within one of said first and said second outer edge segments means for producing additional torsional forces that increase the securing capability of said apparatus.

14. An apparatus according to claim 13, wherein said additional torsional force means comprises a torsional twist in said filaments comprising said first and said second outer edge segments.

15. A symmetrical, flattened, and elongated clamping apparatus for securing sheets of thin material to one another comprising an endless filament shaped to provide two oppositely facing pincers, wherein each of said oppositely facing pincers comprises:

a) a first pincer finger member comprising:
- a first tip segment having first and second ends;
- a first outer edge segment having first and second ends extending by said first outer edge segment first end from said first tip segment first end along a first outer edge of said apparatus;
- a first inner gripping segment having first and second ends extending by said first inner gripping segment first end from said first tip segment second end along a sheet gripping region;

b) a second pincer finger member comprising:
- a second tip segment having first and second ends;
- a second outer edge segment having first and second ends extending by said second outer edge segment first end from said second tip segment first end along a second outer edge of said apparatus;
- a second inner gripping segment having first and second ends extending by said second inner gripping segment first end from said second tip segment second end along said sheet gripping region;

c) a resilient hinge region comprising first and second torsional hinges with each said first and said second hinges having first and second ends wherein said first torsional hinge first end is continuous with said first outer edge segment second end, said first torsional hinge second end is continuous with said second inner gripping segment second end, said second torsional hinge first end is continuous with said second outer edge segment second end, and said second torsional hinge second end is continuous with said first inner gripping segment second end whereby said first and second torsional hinges urge said first and said second pincer finger members together along said sheet gripping region between said first and said second inner gripping segments thereby securing said thin material; and d) three mutually orthogonal two-fold rotational axes having a common origin midway between said first and said second tip segments and said first and said second torsional hinges wherein two of said three two-fold rotational axes form a plane generally bisecting said tip segments, said outer edge segments, said torsional hinges, and said inner gripping segments while said third axis projects above and below said clamping apparatus.

16. An apparatus according to claim 15, wherein said first and said second inner gripping segments overlap each other in said sheet gripping region at three contact gripping regions for securing said thin material.

17. An apparatus according to claim 15, wherein said first and said second tip segments each bend concavely towards one another thereby enabling each said outer edge segment to contact said thin material essentially throughout said outer edge segment's length.

18. An apparatus according to claim 15, further comprising within one of said first and said second outer edge segments means for producing additional torsional forces that increases the securing capability of said apparatus.

19. An apparatus according to claim 18, wherein said additional torsional force means comprises a torsional twist in one or said first and second outer edge segments.

20. A generally symmetrical, flattened and elongated clamping apparatus for securing at least one sheet of thin material, comprising an endless filament shaped to provide a resilient pincers facing in one direction and adapted to function also as an equal resilient pincers facing in the opposite direction, with each said resilient pincers comprising a resilient hinge region connecting and urging together an opposing pair of pincer finger members which provide a sheet entrance and a gripping region for said material with each pincer finger member comprising a tip segment, an inner gripping segment, and an outer edge segment wherein said sheet is secured within either of said oppositely facing pincers by said inner gripping segments of said pair of opposing pincer finger members.

* * * * *